US005499851A

United States Patent [19]

Mitchell

[11] Patent Number: 5,499,851

[45] Date of Patent: Mar. 19, 1996

[54] OUTSIDE DOOR HANDLE ATTACHING BRACKET ARRANGEMENT

[75] Inventor: Stephen J. Mitchell, Walled Lake, Mich.

[73] Assignee: Chrysler Corporation, Highland Park, Mich.

[21] Appl. No.: 331,421

[22] Filed: Oct. 31, 1994

[51] Int. Cl.[6] ..... E05C 21/00

[52] U.S. Cl. ..... 292/347; 292/DIG. 31; 292/DIG. 53; 292/337

[58] Field of Search ..... 292/347, 337, 292/336.3, DIG. 31, DIG. 53, DIG. 64

[56] References Cited

U.S. PATENT DOCUMENTS

| | | | |
|---|---|---|---|
| 4,892,342 | 1/1990 | Newman et al. | 292/347 |
| 5,238,276 | 8/1993 | Burns | 292/347 |
| 5,248,175 | 9/1993 | Burns | 292/347 |
| 5,284,373 | 2/1994 | Watson | 292/347 |
| 5,340,174 | 8/1994 | Bender et al. | 292/336.3 |

*Primary Examiner*—Steven N. Meyers
*Assistant Examiner*—Monica E. Millner
*Attorney, Agent, or Firm*—Christopher A. Taravella

[57] ABSTRACT

A handle assembly, formed with a terminal flange, is adapted for flush installation in a panel aperture from the outboard side of the panel in a rock-in manner with the terminal flange overlying the panel outer surface. The housing has at least one inboard projecting stem receiving a one-piece clip through a hole in a retaining clip enabling a nut, upon being threaded on the stem, to hold handle assembly in the panel opening. The clip of the present invention is initially installed from the inboard side of the panel by means of upper and lower tabs adapted for manual push-on frictional engagement with associated upper and lower tongues projecting inboard from the handle housing. As a result of the clip tabs being manually engaged the installer has both hands free for threading a nut on the stem and torquing the nut down to complete the handle assembly installation. The housing tongues also provide a support function in that they prevent the clip from being distorted during the torquing operation.

10 Claims, 3 Drawing Sheets

FIG. 3.
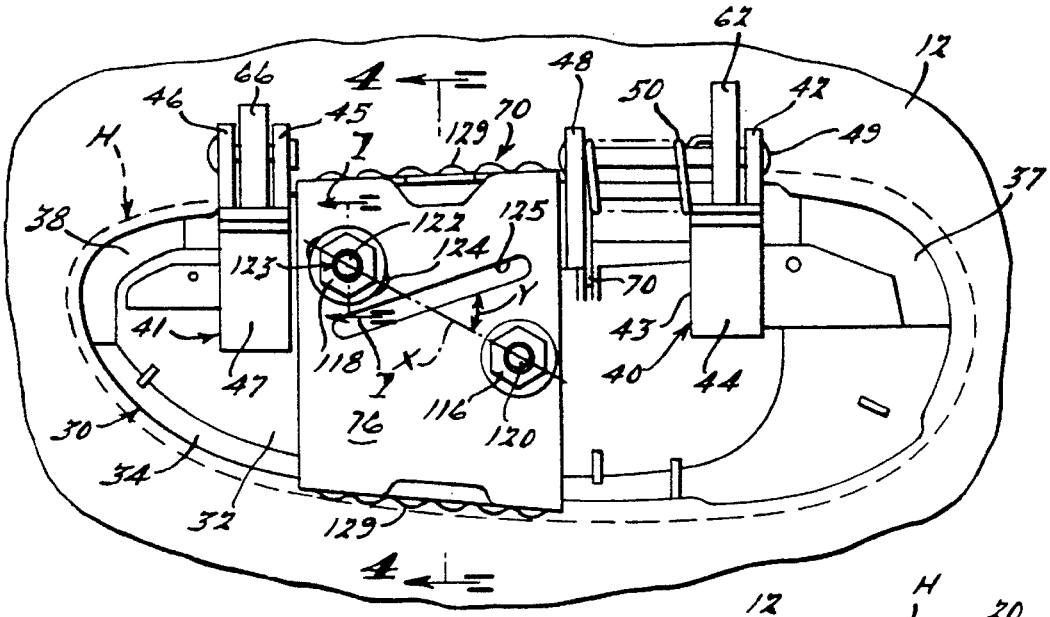
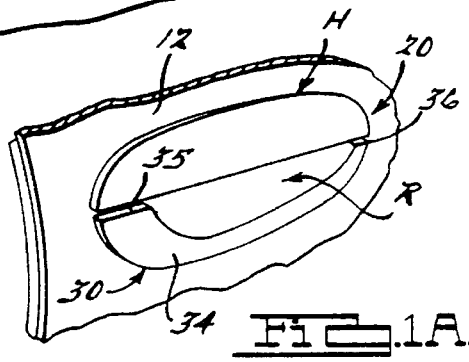
FIG. 1A.
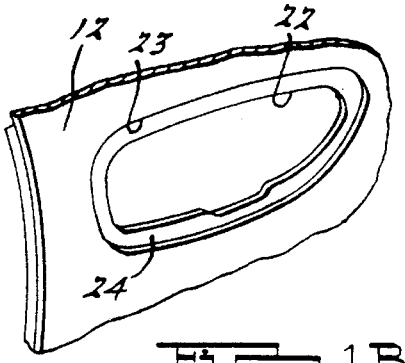
FIG. 1B.
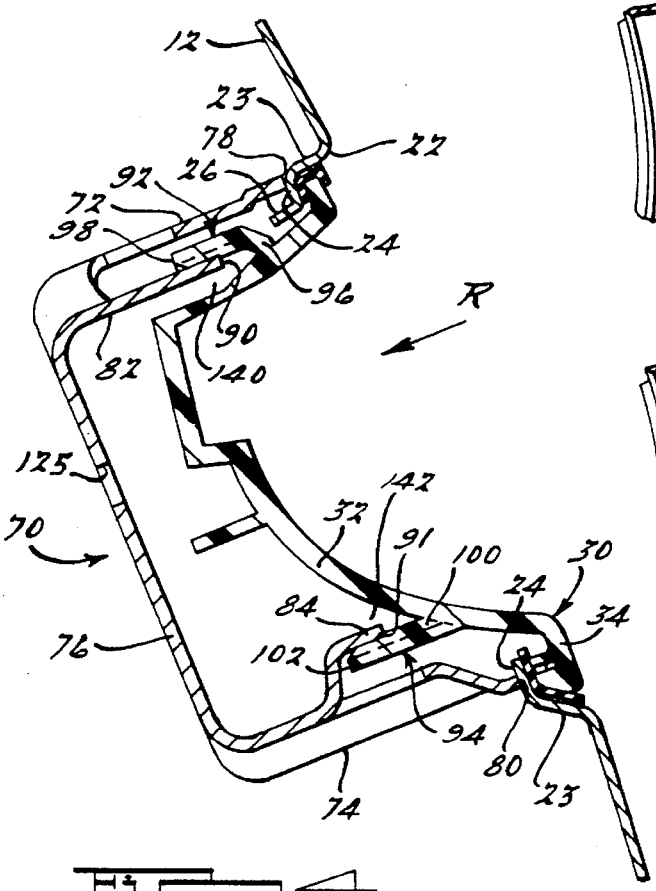
FIG. 4.

OUTSIDE DOOR HANDLE ATTACHING BRACKET ARRANGEMENT

BACKGROUND OF THE INVENTION

This invention relates generally to handle assemblies for motor vehicles and more particularly to an improved attaching arrangement for mounting a flush-type outside door handle assembly in an exterior body panel aperture.

One example of a prior art outside handle assembly mounting arrangement presently used on Chrysler Corporation vehicles is shown in the U.S. Pat. No. 5,340,174 issued to Bender et al. on Aug. 23, 1994. Vehicle handles, such as the Bender et al. door handle for example, are received at the vehicle assembly plant separate from the attaching brackets and fastener end item parts required to mount the handle to the body panel. This requires an additional end item be handled separately from the handle together with several manual operations needed to attach the handle to the door panel using the bracket and fastener parts.

Another example of a vehicle handle attaching arrangement is shown in U.S. Pat. No. 5,238,276 issued Aug. 24, 1993 to Burns. The Burns patent discloses a handle assembly comprising a release handle mounted within a recess of the handle housing which is adapted for flush installation in an exterior vehicle door panel aperture. The housing is mounted in the panel aperture in a rocked-in manner with its terminal flange overlying the aperture recessed flanged border. The housing central body has an inboard projecting stem adapted to support a clip which, when fixed to the stem by a fastener, locks the handle assembly in the panel aperture.

SUMMARY OF THE INVENTION

Accordingly, it is a feature of the present invention to provide an improved motor vehicle handle attaching arrangement comprising a one-piece C-shaped sheet metal mounting clip having an initial self-retained mode during assembly of the handle in a door panel aperture from the door exterior. The clip has lanced-out upper and lower outboard projecting tabs with their extremities defining cutting edges of which are dimensioned to mutually engage, in a self-centering manner, an opposed extremity of each of a plurality of parallel ribs integrally formed on associated upper and lower handle housing inboard projecting tongues. Upon manually sliding the clip outboard each upper and lower tab cutting edge is adapted to simultaneously shear-off a portion of its associated upper and lower plurality of ribs thereby initially frictionally attaching the clip on the housing in a self-retained initial installed position. As a result the installer's hands are free for completing the installation of the housing assembly.

It is a further feature of the present invention to provide an improved motor vehicle door handle attaching arrangement as set for above wherein the C-shaped clip has a planar base formed with upper and lower outboard projecting legs the extremities of which are each adapted to engage an opposed inboard facing surface of a flanged border of the panel aperture with the clip in its initial installed position. It is another feature of the present invention to provide an improved handle assembly as set forth above wherein the housing vertically spaced tongues have opposed upper and lower surfaces each formed with a plurality of upper and lower laterally extending parallel plastic ribs which are triangular in cross section and wherein each rib inboard self-centering extremity is in the form of a lead-in chamfer.

It is still another feature of the present to provide an improved handle assembly as set forth above wherein each housing tongue having integral side webs defining, with the housing, a pocket for receiving its associated C-shaped clip tab. Upon the installer tightening the nut from the panel interior the outboard extremities of the clip legs are urged into contact with the aperture flanged border causing the clip base to be resiliently bowed until its out board surface is impressed into contact with the fastener shoulder, thereby establishing the final installed position of the handle in the aperture. The upper and lower tongues, by virtue of being reinforced by their associated pocket side webs, are adapted to obviate flexible diverging distortion of the upper and lower parallel clip legs upon the clip base being flexibly bowed out during tightening of the nut.

BRIEF DESCRIPTION OF THE DRAWINGS

Other features and advantages of the invention, such as improved appearance and service disassembly, will be evident from the following detailed description of the preferred embodiment of the invention and the accompanying drawings wherein:

FIG. 1A is a fragmentary perspective view showing the door handle assembly mounted in a door panel opening with the door handle in its flush door latched position;

FIG. 1B is a fragmentary perspective view of a door panel outer surface showing an elongated aperture therein adapted to receive the door handle assembly of FIG. 1A;

FIG. 3 is a fragmentary vertical sectional view taken substantially along the line 9—9 of FIG. 4;

FIG. 4 is a view of the handle assembly received in the panel aperture similar to FIG. 2 with the retaining bracket secured;

DETAILED DESCRIPTION OF THE INVENTION

Figure 1:
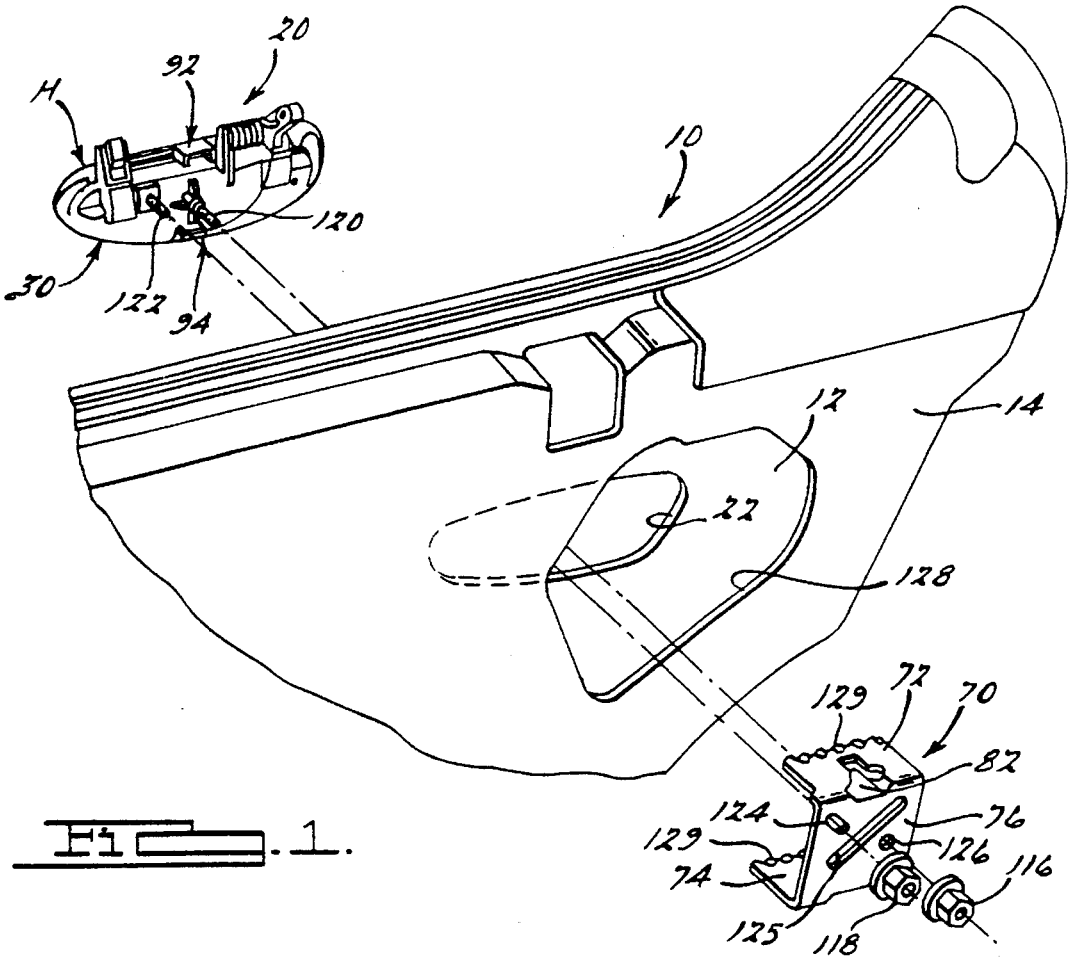
FIG. 1 is a fragmentary exploded perspective view of a door handle assembly mounted in an exterior door panel aperture in a flush door closed position.

Referring now to the drawings and more particularly to FIG. 1 wherein a portion of an automobile rear door is indicated generally at 10 comprises an outer door panel 12 and an inner door panel 14. FIG. 1A shows the outer panel 12 receiving a flush type outside door handle assembly 20 for operating a conventional door latch (not shown). The door panel 12 is shown formed with a generally oval-shaped handle aperture 22 configured to accommodate the handle housing assembly 20.

Figure 6:
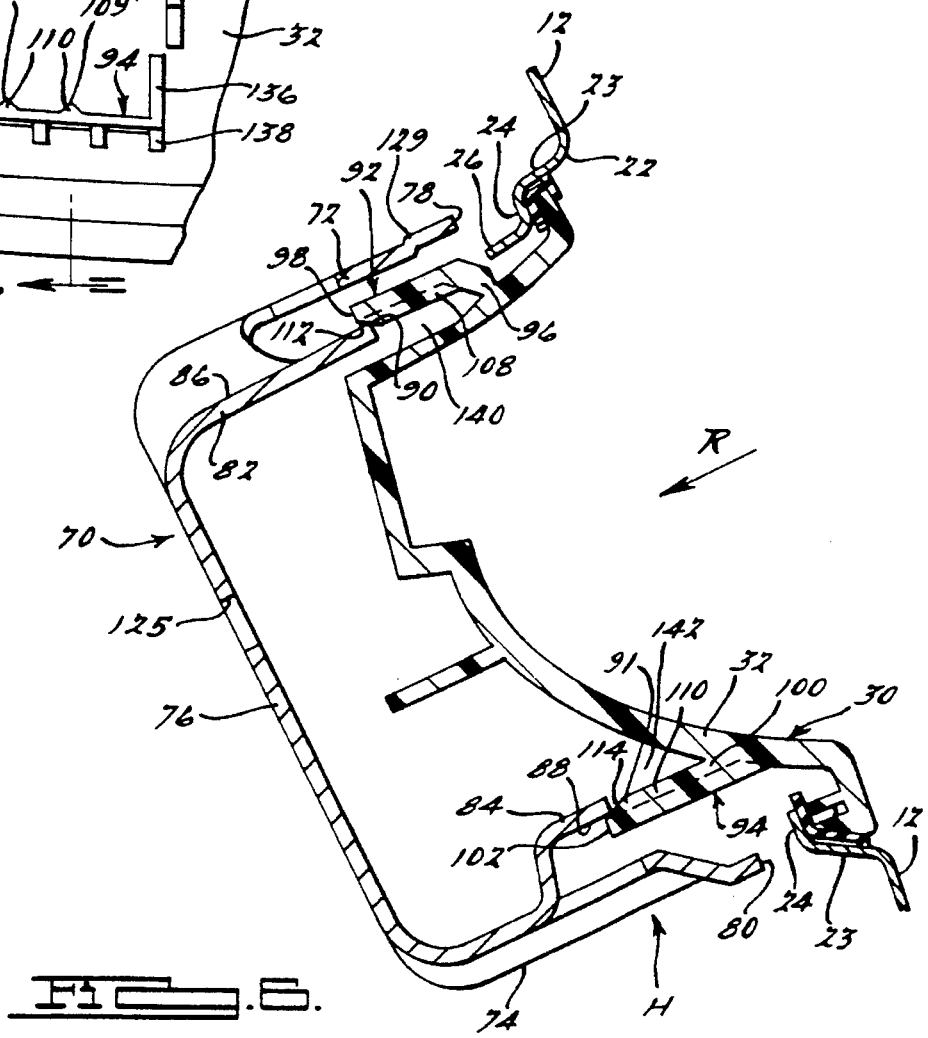
FIG. 6 is a fragmentary vertical sectional view taken on the line 6—6 of FIG. 5.

As best seen in FIGS. 4 and 6 the panel aperture 22 is defined by a continuous inturned flange 23 and a flanged border 24 shown recessed inboard in a manner conforming to the contour of the apertured panel 12. The flanged border 24 has its upper portion terminating in a stiffening leg 26 substantially normal to the panel 12. The panel aperture 22 is adapted to receive the handle assembly 20 from the outboard side of the panel 12 rocked-in about a predetermined swingline established by an installation pivot described generally in the above cited Burns U.S. Pat. No. 5,238,276, the disclosure of which is incorporated by reference herein.

As more fully set forth in the Burns patent the handle assembly 20 includes a housing 30, preferably of molded plastic, having an inboard facing convex central body portion 32 defining an outboard facing generally oval-shaped central concave recess R (FIG. 1). The recess R is sized for inserting the operator's fingers behind a release handle H pivotally mounted on the housing for location between an extended operable position and a retracted inoperable position within the recess. FIGS. 1 show the housing member central recess R having an outwardly extending integral continuous upwardly opening C-shaped perimeter flange portion 34 extending around the periphery of the body portion 32 except for an upper segment to be described. The housing terminal flange 34 seats on the exterior surface of on the complementary flanged border 24 around the periphery of panel aperture 22. As seen best in FIG. 1A, the C-shaped terminal flange portion 34 comprises a crescent shaped lower half sector terminating at fore and aft horizontally disposed contour lines 35 and 36, respectively, partially defining a pair of substantially mirror image upper arcuate handle flush mounting end sector depressions 37 and 38.

Figure 2:
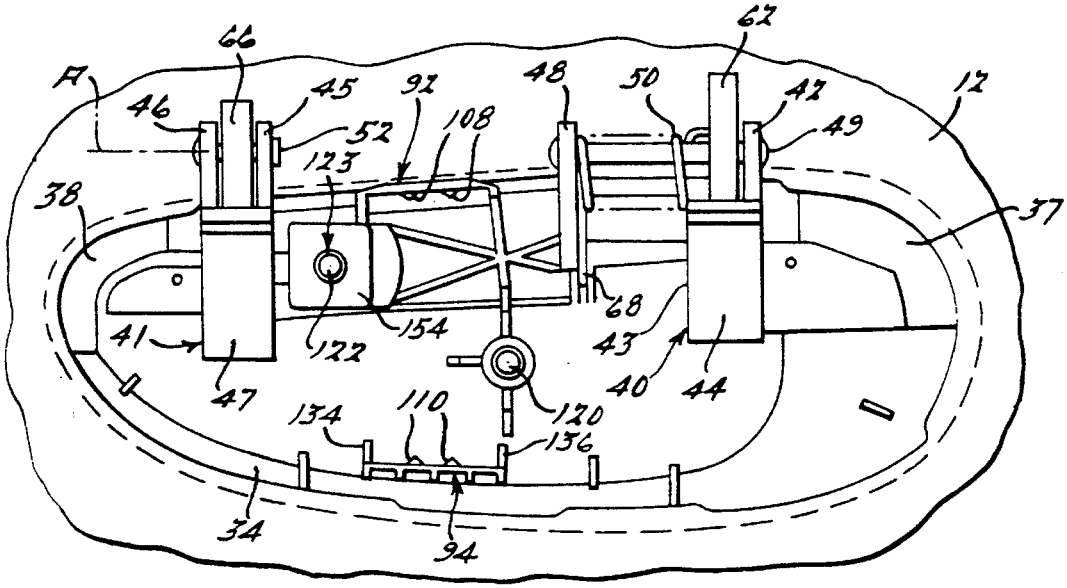
FIG. 2 is a fragmentary view of the inner surface of the door panel of FIG. 1 showing the handle assembly mounted thereon prior to attachment of the mounting bracket.

With reference to FIGS. 3 and 4, the housing 30 is preferably molded from a polymeric or plastic glass filled material with the depressed body portion 32 integrally formed with forward or first 40 and aft or second 41 longitudinally spaced box or shroud-like upstanding handle pivot brackets. The forward handle pivot bracket 40 comprises spaced parallel support walls 42, 43 and a bight wall 44 while the aft handle pivot bracket 41 comprises spaced parallel support walls 45, 46 and a bight wall 47. The extension of support wall 42 provides a bore which, together with an intermediate support wall 48 aligned bore, journally receives a first or forward pivot pin 49 surrounded by a return compression coil spring 50. The spring 50 one end abuts the intermediate support wall 48 and the forward pivot pin 49 is aligned on release handle pivot axis "A", as seen in FIG. 2. A second or aft pivot pin 52 is journalled on the pivot axis "A" by means of a pair of aligned bores provided in the respective extensions of support walls 45 and 46.

It will be noted that an integral cylindrical shaped hollow socket portion (not shown) may be formed adjacent the aft end the housing body portion 32 for the reception of a conventional lock cylinder as depicted in the handle of the above mentioned Newman U.S. Pat. No. 4,892,342, for example. A vehicle outside door handle assembly for the rear doors of a four-door sedan model, such as the handle assembly 20, requires no lock cylinder and accordingly is omitted from the description.

In FIGS. 1–3, the flush-type release handle H, also formed of molded plastic, is shown normally pivotally received in its retracted inoperable position in housing recess "R". The release handle H is adapted to be pivoted from its normal retracted position, flush with the outer surface of the door panel 18, to its extended operable position wherein it is grasped by the operator and rotated outwardly. The handle H is rotated against the force of the coil spring 50 which normally biases the handle in its retracted position in the recess "R".

The handle H is integrally formed with a first crankarm lever 62 projects through slot (not shown) in the housing body portion 32. The slot is aligned with an associated passageway formed between the first bracket pair of support walls 42 and 43 for receiving the first lever arm 62 therein. Similarly, a release handle second crankarm lever 66 is adapted to project through a slot in the body portion 32 aligned with an associated passageway formed between the second bracket pair of support walls 45 and 46.

In FIG. 4, it will be seen that the coil spring 50 one end radial length 68 captured in a groove formed in the housing body and its other end axial length 74 retained in a hole formed in the first lever arm 62. The spring biases the release handle H toward its normal fully-closed position of FIG. 1A wherein the handle covers the upper portion of the recess "R". The coils of spring 50 are in pressure contact with the pivot pin 49 so as to transfer the springs' reaction force to the pivot pin.

Thus, with reference to the installation, the handle assembly 20 is shown in FIG. 1 being installed from the outboard side of the panel 18 by first tilting the handle assembly toward the horizontal such that the upstanding brackets 40,41 and their associated crankarms 62, 66 lead the assembly into the panel aperture 22. Upon the release handle upper edge engaging an elongated hollow juncture, defined by the inturned flange 23 and the recessed flanged border 24, the installer starts rotating the handle assembly in a clockwise direction. Again, reference may be made to the mentioned '276 Burns patent for a detailed description of the handle assembly installation.

As viewed in FIG. 1, the handle assembly mounting arrangement further comprises a one-piece C-shaped retainer clip, generally indicated at 70. The clip 70 is initially in the form of a stamped flat blank sheet metal blank formed, such as by suitable stamping machine dies, to the disclosed C-shaped clip 70.

The clip 70, as seen in FIGS. 1, 3 and 4, comprises parallel upper 72 and lower 74 legs shown extending outboard from a planer base 76. Each of the clip legs 72 and 74 terminate in longitudinal free end edges 78 and 80, respectively. As seen in FIG. 4 the edges 78 and 80 are adapted to abut the interior surface of panel aperture border flange 24 with the clip securing the handle assembly in its final installed position.

With reference to FIGS. 1 and 4 the clip upper leg 72 and base 76 have a lanced-out partially severed area from which an inboard projecting upper tab 82 is positioned parallel to and off-set below the upper leg 72. The lower leg 74 has a partially severed area providing an inboard projecting lanced-out lower tab 84 positioned parallel to and off-set above the lower leg 74.

It will be noted in FIG. 6 that the upper tab 82 has an upwardly facing surface 86 and the lower tab 84 has a downwardly facing surface 88 arranged in opposite vertically spaced relation. Further, it will be seen that the upper tab 82 defines an inboard longitudinally extending linear upper cutting edge 90 for a purpose to be explained. In a like manner the lower tab 84 defines an inboard longitudinally extending linear lower cutting edge 91.

With reference to FIGS. 2 and 4 the housing central body portion 32 is preferably formed of a suitable plastic material, such as glass/mineral filled Nylon, sold by Allied Chemical under the Tradename "Capron". The housing is shown molded with integral upper 92 and lower 94 inboard projecting retaining tongues. The upper tongue 92 has an outboard end 96 fixedly secured to the body 32 and a free longitudinally extending inboard end 98 while the lower tongue 94 has an outboard end 100 fixedly secured to the body 32 and a free longitudinally extending inboard end 102.

Figure 5:
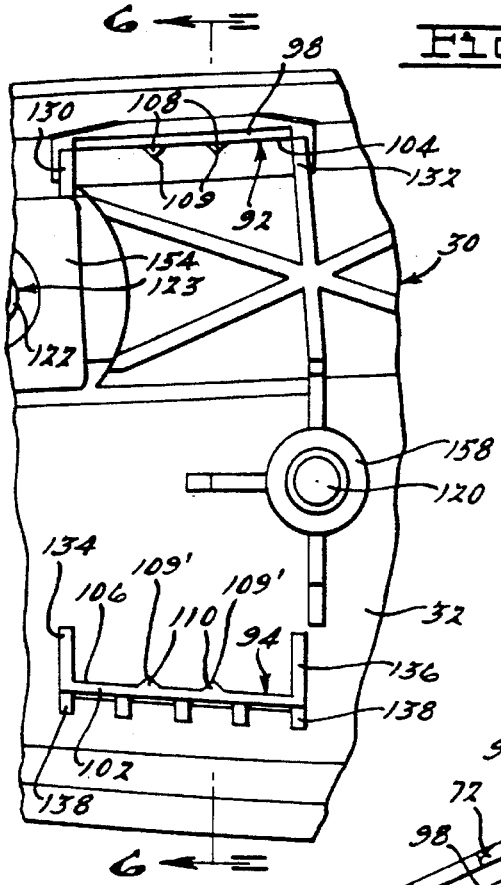
FIG. 5 is an enlarged, fragmentary view of the central portion of the handle housing inner surface shown in FIG. 2.

As best seen in FIG. 5 the upper tongue 92 has a downwardly facing surface 104 and the lower tongue has an upwardly facing surface 106 in opposed vertically spaced relation. The upper tongue under-surface 104 has a plurality of laterally extending longitudinally spaced shear ribs 108 integrally formed thereon. In a like manner the lower tongue opposed surface 106 has a plurality of laterally extending longitudinally spaced integral shear ribs 110 integrally formed thereon. FIG. 5 shows the preferred form of the invention wherein the upper 108 and lower 110 ribs each have an isosceles triangular-shape in cross section arranged with their linear apexes 109 and 109' respectively, in opposed relation.

With reference to FIG. 6 it will be observed that the inboard end of the upper tongue ribs 108 are each formed with a lead-in guide chamfer 112 while the lower tongue ribs 110 are formed with mirror image lead-in guide chamfers 114. The clip tab upper and lower cutting edges 90 and 91 are adapted to be guided into engagement with their associated upper and lower lead-in chamfers 112 and 114 in a manner to be explained. Upon the clip being moved outboard from its FIG. 6 position to its FIG. 4 position, the clip edges 90 and 91 co-act to simultaneously shave-off a portion of their associated upper and lower rib apexes 109 and 109'. Thus, with the clip 70 in its initially installed position of FIG. 4 the upper 82 and lower 84 clip tabs are frictionally retained by their associated tongue upper 108 and lower 110 ribs enabling the operator to release the clip 70 thereby freeing his hands for threading nuts 116 and 118 on their associated housing threaded fasteners described below.

With reference to FIGS. 3 and 5, the housing central body 32 is integrally joined at one anchoring end with a central elongated threaded stud 120. Further, the housing has a threaded stem portion 122 of a floating bolt 123 to be described. As viewed in FIG. 5, the stud 120 and bolt stem 122 are shown project inboard with their principal axes parallel and oriented substantially normal to the installed clip planar base 76.

As depicted in FIG. 1, the C-shaped clip base 76 has an upper corner attaching slot 124 adapted for the reception of bolt stem 122. FIG. 3 shows the corner slot 124 aligned on a diagonally extending construction line "X". It will be noted that an elongated slotted opening 125 is provided in the clip base 76 which extends diagonally so as to intersect the diagonal construction line "X" at an acute angle "Y". Further, the clip base 76 has a lower attaching hole 126, adapted for the reception of the lower central threaded stud 120, shown with its center aligned on the diagonal construction line "X".

It will be observed in FIG. 1 the handle housing 30 is inserted in the outer panel aperture 22 from the door panel exterior while the clip 70 is installed from the door interior, via inner door panel opening 128, as described above. The clip 70 is adapted for location in its predetermined aligned manner of FIG. 6 upon the upper bolt stem 122 being inserted through clip base attaching slot 124 together with the lower stud 120 inserted through the clip base lower attaching hole 126. The stud 120 and the parallel bolt stem 122 thereby provide initial locating guides enabling the clip upper and lower tab outboard cutting edges or extremities 90 and 91 to mutually contact their associated lead-in chamfers 112 and 114.

With reference to FIG. 4 the clip 70 is shown in its initial installed position with its upper and lower legs have their free ends or extremities 78 and 80 respectively, positioned in contact with inner opposed surface portions of the flanged border 24. Upon the nuts 116 and 118 being tightened on their associated threaded stud 120, anchored in the housing, and threaded bolt stem 122 of the floating bolt 123, the clip leg extremities 78 and 80 exert outboard pressure on the flanged border 24. Accordingly, it is important that torquing or tightening of the nuts 116 and 118 does not cause the upper leg 72 to diverge upwardly and the lower leg 74 to diverge downwardly. Such divergence may result in the leg extremities 78 and 80 being moved out of contact with the flanged border 24 causing the outer door panel 12 warpage and form wrinkles or the handle assembly to loosen.

FIG. 1 shows each clip leg extremity formed with a series of sine-like corrugations 129 thereby increasing the effective vertical edge area available for contacting the panel aperture flanged border 24. It will also be seen that the clip base 76 is provided with a diagonal slotted opening 125 to increase its flexibility.

With reference to FIG. 5 it will be seen that the upper tongue 92 is reinforced at its fore and aft ends by side webs 130 and 132, respectively. In a similar manner the lower tongue 94 is reinforced at its fore and aft ends by side webs 134 and 136, respectively, together with a plurality of transverse integral support braces 138. It will be appreciated that the each upper 92 and lower 94 tongue, together with its associated side webs and adjacent housing body portion, define upper and lower tongue pockets 140 and 142 (FIG. 6). The upper pocket 140 is adapted to receive therein the clip upper tab 82 while the lower tongue pocket 142 is adapted to receive therein the clip lower tab 84. The upper 140 and lower 142 reinforced tongue pockets obviates distortion of the clip legs as they are urged into contact with the aperture flanged border.

Figure 7:
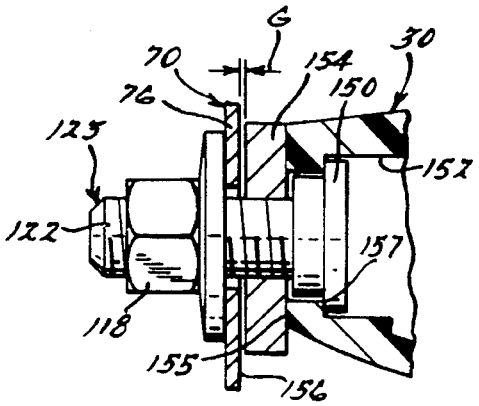
FIG. 7 is a fragmentary enlarged vertical sectional view taken on the line 7—7 of FIG. 3.

As best seen in FIG. 7 the upper floating bolt 123 has its head 150 trapped in a housing stepped bore 152 sized to receive the bolt 123 in a floating manner limited axial and lateral alignment. The bolt stem 122 is thus free to be aligned with the clip diagonal slot 124 after which a plate nut 154 is threadably tightened down on housing face 155 locking the bolt head 150 on the bore shoulder 157.

It will be noted in FIG. 7 that with the clip 70 in its self-retained initial installed position of FIG. 4 the clip base 76 is spaced a predetermined dimension, about 0.75 mm in the disclosed embodiment, creating a gap "G" between the plate nut 154 and opposed base surface 156. Upon the flanged nut 118 being tightened on bolt stem 122 the clip base 76 is flexibly bowed outboard into face-to-face contact with the plate nut 154. In a like manner upon the flanged nut 116 being tightened on threaded stud 120 the clip base surface 156 is drawn into contact with annular shoulder 158 at the stud anchored end.

Thus, tightening of the nuts 118 and 120 completes the handle assembly installation wherein the clip leg extremities 78 and 80 are flexed outboard into biased contact with the aperture flanged border 24 by the bowed pre-stressing the clip base 76. Applicant's arrangement thereby assures that the handle assembly 20 will withstand repeated opening loads applied to the handle "H" during its design life.

While there is described above the principles of this invention in connection with a specific embodiment, it is to be clearly understood that this description is made only by way of example and not as a limitation to the scope of this invention.

What is claimed is:

1. In a handle assembly adapted for mounting in an aperture formed in a vehicle panel having exterior and interior surfaces, the assembly having a housing formed with a terminal flange surrounding a central body portion, the terminal flange formed with a backside adapted for seating on a flanged border surrounding the panel aperture, an improved handle assembly panel mounting arrangement comprising:

a housing of plastic material having an inboard facing central body portion formed with integral upper and lower inboard projecting tongues each terminating in an inboard end, said upper tongue having a downwardly facing surface and said lower tongue having an upwardly facing surface, each said upwardly and downwardly facing surface formed with a plurality of laterally extending ribs arranged in vertically opposed spaced relation, each upper and lower laterally extending rib inboard ends sloped in a manner defining outboard converging upper and lower lead-in chamfers;

a C-shaped sheet metal clip having upper and lower parallel legs each extending normally outboard from a clip base portion having at least one attaching hole therein, each upper and lower leg outboard extremity adapted to engage an opposed inboard surface of said panel aperture flanged border;

said clip providing elongated outboard extending upper and lower attaching tabs, said upper tab spaced below and parallel with said upper leg and having an upwardly facing surface, and said lower tab spaced above and parallel with said lower leg and having a downwardly facing surface, said upper and lower tab surfaces in vertically spaced opposed relation and each terminating in a cutting edge adapted to engage associated upper and lower rib lead-in chamfers; and whereby upon said clip base attaching hole receiving therethrough a threaded fastener extending inboard from said housing central portion said clip tab upper and lower cutting edges are vertically spaced a predetermined dimension, such that upon said clip being manually urged outboard each said upper and lower tab cutting edges adapted to simultaneously shear-off a portion of its associated upper and lower ribs thereby frictionally engaging said clip on the housing in an initial installed position in a self-retained manner.

2. The handle assembly mounting arrangement as set forth in claim 1 wherein upon an installer tightening a nut on said threaded fastener bowing said clip base a predetermined dimension outboard into contact with an opposed surface on said housing resulting in each said clip leg outboard extremity being resiliently pressed against an opposed inboard surface of said panel aperture flanged border in a prestressed manner.

3. The handle assembly mounting arrangement as set forth in claim 1 wherein each said upper and lower rib as viewed in cross section providing an isosceles triangle configuration, such that said upper and lower ribs having their apexes in opposed relation whereby, upon said clip being manually urged outboard to its initial installed position, each said upper and lower tab cutting edge shearing-off a portion of their associated rib apexes thereby frictionally engaging said clip on the housing in said initial installed position.

4. The handle assembly mounting arrangement as set forth in claim 2 wherein each said upper and lower tongue integrally formed with reinforcing web portions defining, with an associated housing body portion, upper and lower tongue pockets, such that upon the installer tightening a nut on said threaded fastener said upper and lower tongue pockets obviate distortion of its associated clip leg.

5. The handle assembly mounting arrangement as set forth in claim 1 wherein at least one of said tabs is formed by being lanced-out of a clip leg.

6. The handle assembly mounting arrangement as set forth in claim 4 wherein at least one of said tabs is formed by being lanced-out of said clip base.

7. The handle assembly mounting arrangement as set forth in claim 1 wherein said housing central body has a pair of elongated threaded fasteners projecting inboard therefrom with a principal axis of each said fastener oriented normal to said clip base, said clip base being rectangular in shape and having one attaching slot therein in an upper corner thereof aligned on a diagonal construction line and one attaching hole in a diagonally opposite lower corner thereof with its center located on said construction line, whereby upon said clip base attaching slot receiving therethrough one of said pair of threaded fasteners and said clip base attaching hole receiving therethrough the other of said pair of threaded fasteners.

8. The handle assembly mounting arrangement as set forth in claim 7 wherein said one of said pair of threaded fasteners adapted to be received in said attaching slot in the form of a floating bolt having its head captured in a housing bore, whereby said bolt adapted for limited adjustment enabling its threaded stem to be received in said attachment slot with the remaining other of said pair of threaded fastener aligned with clip base said attaching hole.

9. The handle assembly mounting arrangement as set forth in claim 7 wherein said clip base formed with a diagonally extending slotted opening intersecting said diagonal construction line, said slotted opening enabling said clip base to resiliently flex outboard upon a retaining nut being torqued-down on its associated threaded fastener.

10. The handle assembly mounting arrangement as set forth in claim 1 wherein each clip leg outboard extremity having a longitudinally extending edge formed with a series of sine-like corrugations thereby increasing the vertical contact edge dimension insuring bearing contact with said aperture flanged border in said clip final installed position.

* * * * *